US006419562B1

(12) United States Patent
D'Ambra

(10) Patent No.: US 6,419,562 B1
(45) Date of Patent: Jul. 16, 2002

(54) METHOD AND APPARATUS FOR SHARPENING DRILL BITS

(76) Inventor: Paul A D'Ambra, 109 Jenkins Rd., Andover, MA (US) 01810

( * ) Notice: Subject to any disclaimer, the term of this patent is extended or adjusted under 35 U.S.C. 154(b) by 0 days.

(21) Appl. No.: 09/738,426

(22) Filed: Dec. 18, 2000

(51) Int. Cl.[7] ..... B24B 1/00

(52) U.S. Cl. ..... 451/48; 451/5; 451/6; 451/8; 451/11; 451/246

(58) Field of Search ..... 451/5, 6, 8, 11, 451/48, 246

(56) References Cited

U.S. PATENT DOCUMENTS 5,655,354 A * 8/1997 Baker et al. ..... 53/474
6,283,824 B1 * 9/2001 Mortell et al. ..... 451/5

* cited by examiner

*Primary Examiner*—Joseph J. Hail, III
*Assistant Examiner*—Shantese McDonald

(74) *Attorney, Agent, or Firm*—Devine, Millimet & Branch, P.A.; Paul C. Remus; Todd A. Sullivan

(57) ABSTRACT

This invention results from the realization that a drill bit can be positioned for sharpening without using the flawed tip as a reference point allowing the drill bit to be sharpened with an insignificant level of human judgment and with consistently less flawed results. This inventive method for properly positioning a drill bit to be sharpened involves selecting a drill bit with a substantially helical geometric shape, a feature common to most drill bits. The next step is viewing a drill bit with a digital imaging device. Either an individual or, preferably, a computer determines the geometric shape of the drill bit. An individual or automated mechanism then calculates a sharpening position, relative to a sharpening means, such as sharpening wheels, for sharpening the drill bit based on the geometric shape of the drill bit. Automating this step may involve calibrating the machine by first manually positioning the drill bit and then programming a machine to similarly position all similarly shaped drill bits. The final step to this inventive method is placing the drill bit in the sharpening position, relative to the sharpening means.

6 Claims, 6 Drawing Sheets

METHOD AND APPARATUS FOR SHARPENING DRILL BITS

FIELD OF THE INVENTION

This invention relates to the field drill bit sharpening. More specifically, this invention relates to the field of sharpening fine drill bits frequently used for drilling holes in printed circuit boards. Even more specifically, this invention relates to the procedure for properly positioning the drill bit to be sharpened before sharpening it.

BACKGROUND OF THE INVENTION

The inspiration of this invention centers on the need to reuse dulled drill bits used for drilling holes in circuit boards. Circuit boards are sensitive materials that require special types of drill bits that are quite costly. The drill bits are used in extensive quantity and dull often. Once the drill bits begin to dull, they will regularly damage circuit boards if not replaced. Thus it has become more cost effective to resharpen drill bits and reuse them, than discarding dulled drill bits.

Sharpening a drill bit in this field means sharpening the drill bit tip, as the web of the drill bit rarely suffers enough wear to require sharpening. The most difficult task in sharpening the drill bit tip is ascertaining where along the drill bit tip the edge is supposed to be located. Once the location for the sharpening is properly located, applying the drill bit to the necessary grinding devices becomes a simple process. Failure to ascertain the correct location can result in improper grinding and sharpening that will require discarding or resharpening the drill bit. As every drill bit can only be sharpened a finite number of times before being worn down too far to be resharpened and reused, an improperly sharpened drill bit is a costly problem.

One method of ascertaining the location for the drill bit tip edge is simply using the human eye. The drill bit is held within a rotating arm of a machine and operators of the machine peer at the drill bit tip through a microscope, which normally has cross hairs on the lens. The machine operators can then rotate the arm of the machine by fractions of degrees to rotate the drill bit until the edge of the used drill bit lines up with the cross hairs.

This method has several flaws. The greatest flaw is using the drill bit tip to determine where the drill bit tip edge should be. After the number of times the drill bit has been used, the drill bit tip is dulled and flawed. It would seem obvious that using a flawed piece of the structure to correct the structure's flaw is an imperfect procedure. Depending on the condition of the tip, the individual sharpening the tip is required to use a degree of judgment in determining where the tip belongs in relation to its altered state. As a result, the sharpening is a very imperfect science resulting in improperly sharpened drill bits.

Another problem with this method is its dependency on human judgment. Human operators, without any scientific backing, are left to judge where along the drill bit tip the sharpened edge belongs. Using a flawed tip and the cross-hairs in the microscope, the operators must choose the location to sharpen on a trial and error basis. This guessing method causes inconsistent results.

Another problem with this method is it is often difficult to determine whether the drill bits were improperly sharpened. The manufacturer using the drill bits doesn't have the time to examine each drill bit under a microscope to determine if the sharpened edge on the drill bit tip is flawed. While sometimes flawed sharpened drill bits will result in obvious damage to the circuit boards, other times the flawed sharpened drill bits will result in non-obvious damage to the circuit boards that is only discovered after the eventual circuit board users discover the circuit boards are dysfunctional. Therefore the unpredictable results that come with human operators using a flawed system are a serious problem.

Another method for finding the edge to sharpen drill bits is using a digital imaging device to view the drill bit in the same manner the human operator was viewing the drill bit in the other method. The digital imaging device finds the location of the drill bit tip and allows the operator to position the drill bit for sharpening much more smoothly. However this method also contains the same flaws as the previous method. This method depends on a flawed piece of the drill bit structure to correct the structure flaw. This method requires trial and error judgment based on the condition of the drill bit to sharpen it. This method produces drill bits with flawed tips inconsistently.

SUMMARY OF THE INVENTION

This invention results from the realization that a drill bit can be positioned for sharpening without using the flawed tip as a reference point allowing the drill bit to be sharpened with an insignificant level of human judgment and with consistently less flawed results.

It is therefore an object of this invention that the drill bits get positioned for sharpening without regard to the condition of the drill bit tip.

It is therefore a further object of this invention that the drill bits get positioned for sharpening without depending on separate human judgment for each drill bit.

It is therefore a further object of this invention that the drill bits get positioned for sharpening based on consistent calculations referencing the geometric shape of the drill bits.

BRIEF DESCRIPTION OF THE DRAWINGS

The novel features believed characteristic of the invention are set forth in the claims. The invention itself however, as well as other features and advantages thereof, will be best understood by reference to the description which follows, read in conjunction with the accompanying drawings, wherein:

DETAILED DESCRIPTION OF THE INVENTION

Figure 1:
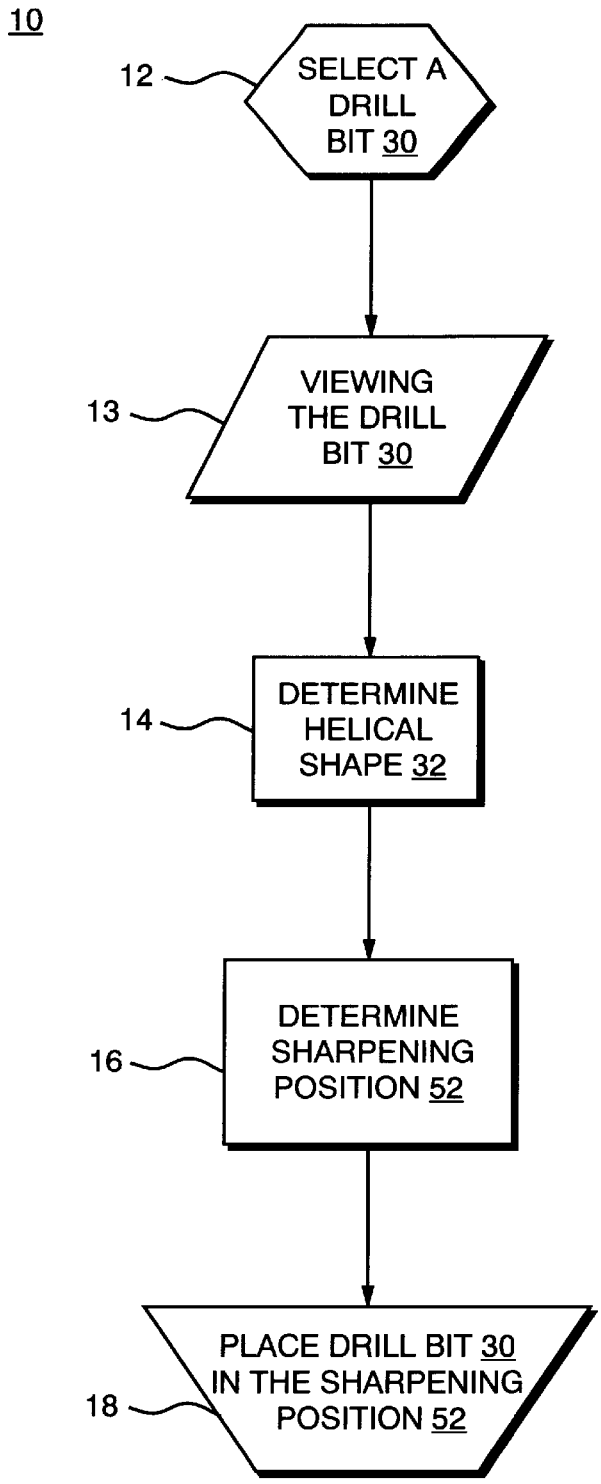
FIG. 1 shows a flow chart of the claimed method for properly positioning a drill bit to be sharpened.
Figure 4:
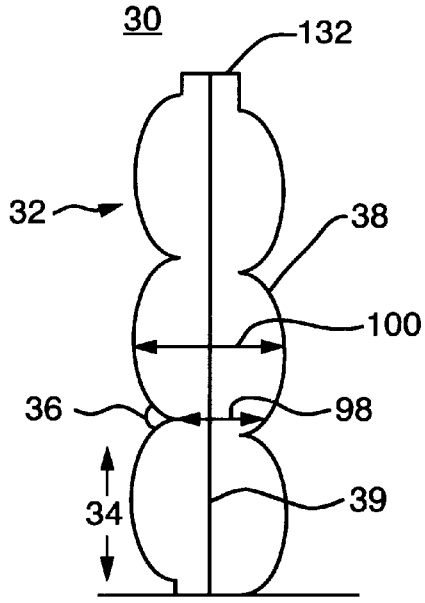
FIG. 4 shows a profile of a drill bit.

This method 10, in FIG. 1, for properly positioning a drill bit 30, in FIG. 4, to be sharpened involves selecting 12 a drill bit 30 with a substantially helical geometric shape 32, a feature common to most drill bits. The next step is viewing 13 a drill bit 30 with a digital imaging device 40, in FIG. 5. Either an individual or, preferably, a computer determines 14 the geometric shape 32 of the drill bit 30. An individual or automated mechanism then calculates 16 a sharpening position, relative to a sharpening means 50, in FIG. 7, such as sharpening wheels, for sharpening the drill bit 30 based on the geometric shape 32 of the drill bit 30. Automating this step may involve calibrating the machine by first manually positioning the drill bit 30 and then programming a machine to similarly position all similarly shaped drill bits 30. The final step to this inventive method is placing 18 the drill bit in the sharpening position, relative to the sharpening means 50.

Figure 2:
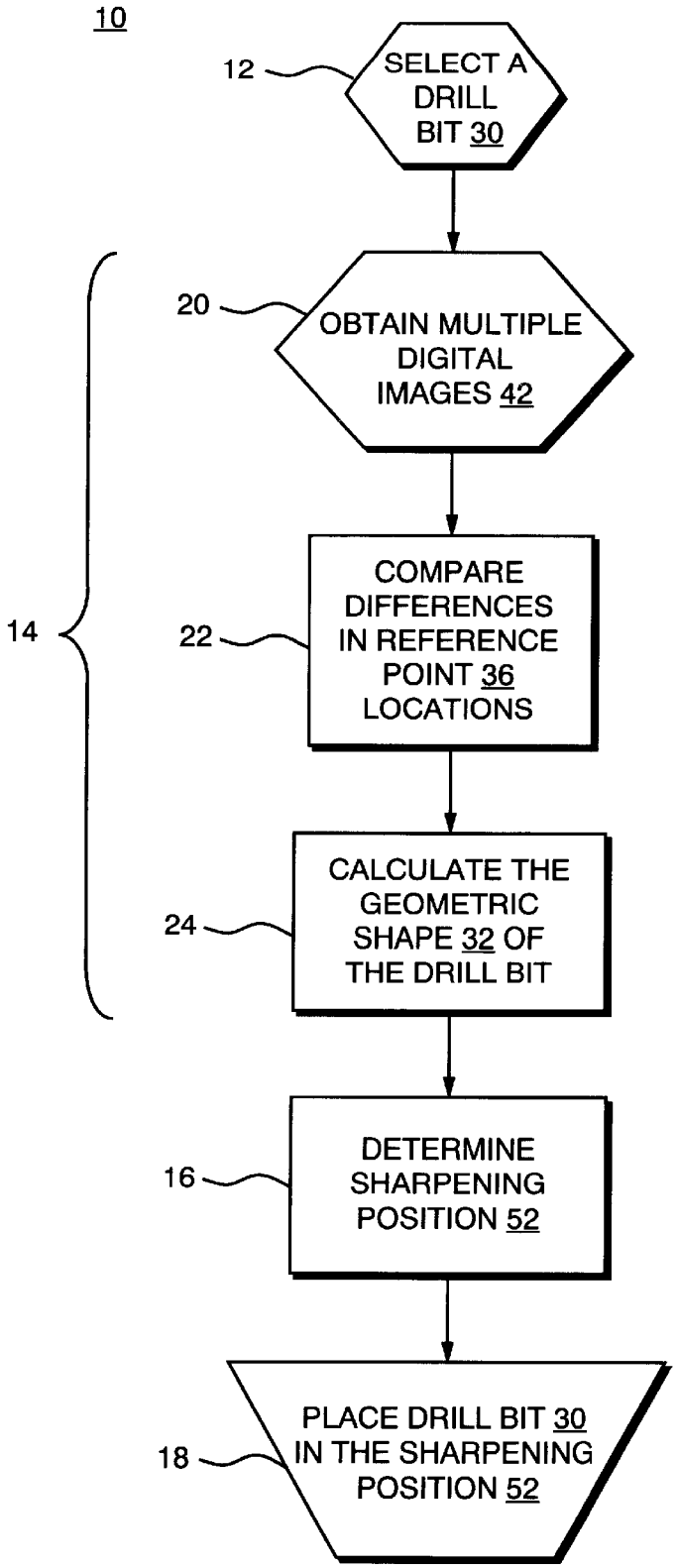
FIG. 2 shows a flow chart of another embodiment of the claimed method for properly positioning a drill bit to be sharpened.

One method for determining 14, in FIG. 2, the geometric shape 32 of the drill bit 30 involves obtaining 20 multiple digital images 42 of the drill bit 30 as the drill bit 30 is rotated known units 44 of angular rotation to provide a three dimensional image of the drill bit 30. The next step is comparing 22 a difference in vertical location 34 of a reference point 36 on a helical web 38 on the drill bit 30, visible on at least two of the digital images 42, to the known units 44 of angular rotation between the digital images 42 to further define the three dimensional image. Finally, calculating 24 the geometric shape 32 of the drill bit 30. Limiting the axis on which the drill bit 30 is rotated to the lengthwise axis 39 of the drill bit 30 can narrow this embodiment.

Figure 3:
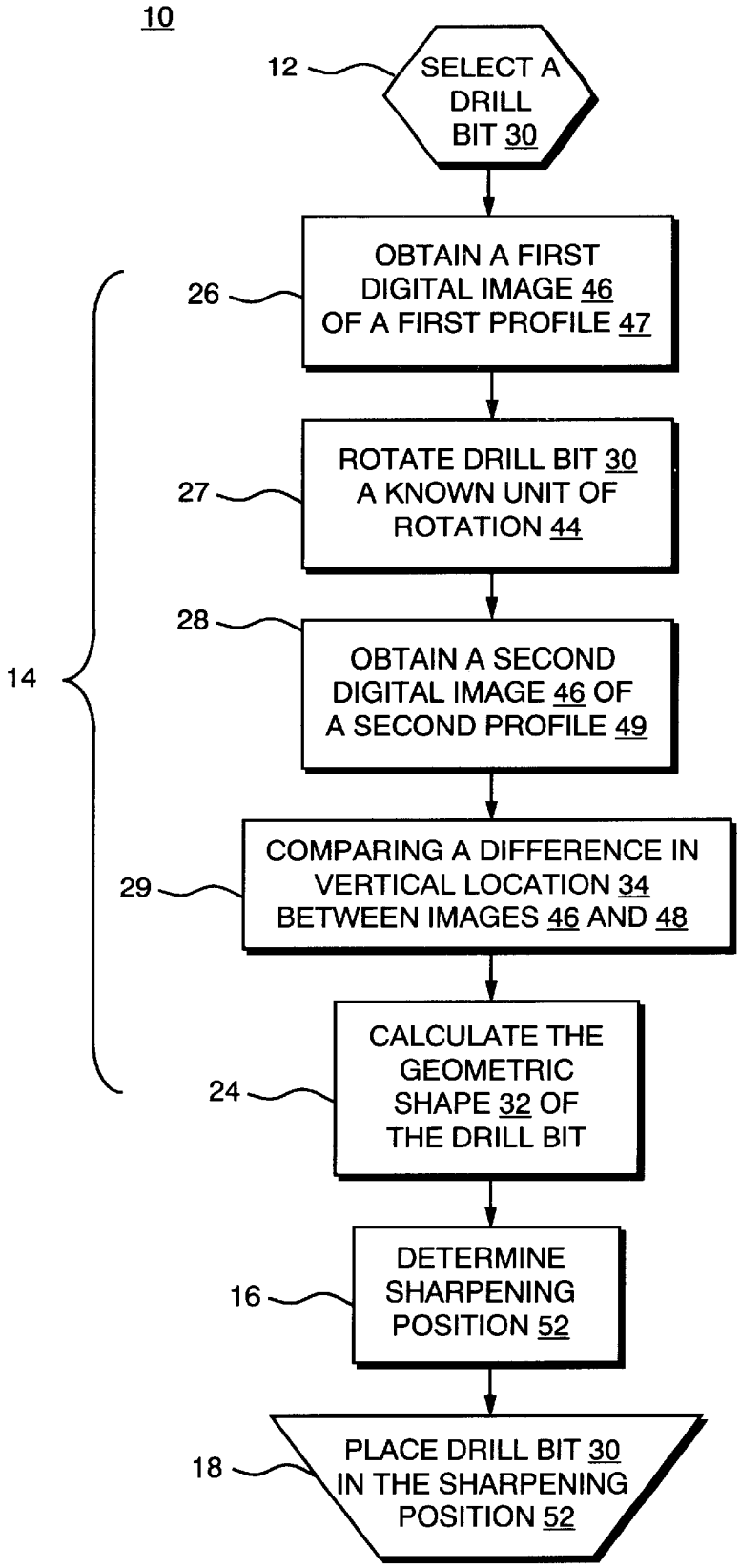
FIG. 3 shows a flow chart of another embodiment of the claimed method for properly positioning a drill bit to be sharpened.
Figure 6:
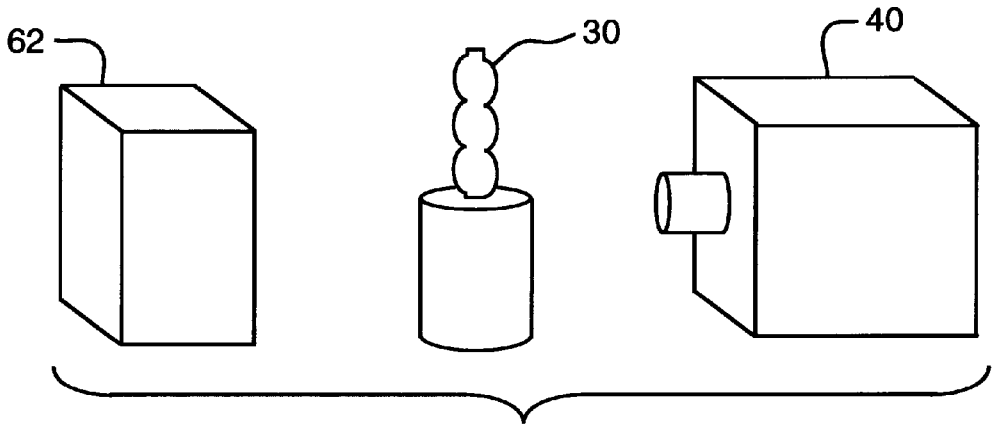
FIG. 6 shows a drill bit being viewed by a digital imaging device.

Another embodiment for determining 14, in FIG. 3, the geometric shape 32 of the drill bit 30 involves obtaining 26 a first digital image 46, in FIG. 6, of a first profile 47 of the drill bit 30. The next step is rotating 27 the drill bit 30 a known unit 44 of angular rotation and obtaining 28 a second digital image 48 of a second profile 49 of the drill bit 30. The next step is comparing 29 a difference in vertical location 34 of a reference point 36 visible on a helical web 38 on the drill bit 30 in both the first profile 47 and the second profile 49 of the drill bit 30 in relation to the known unit 44 of angular rotation by which the drill bit 30 was rotated. The final step is calculating 24 a geometric shape 32 of the drill bit 30.

Figure 5A:
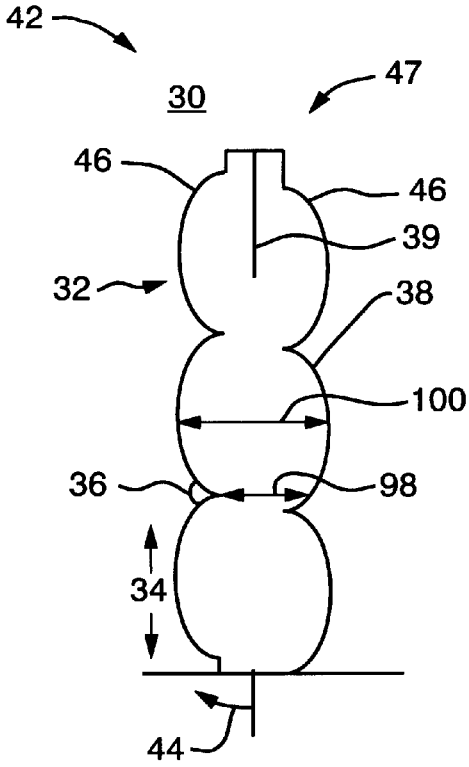
FIG. 5 shows a profile of the drill bit before and after being rotated.
Figure 5B:
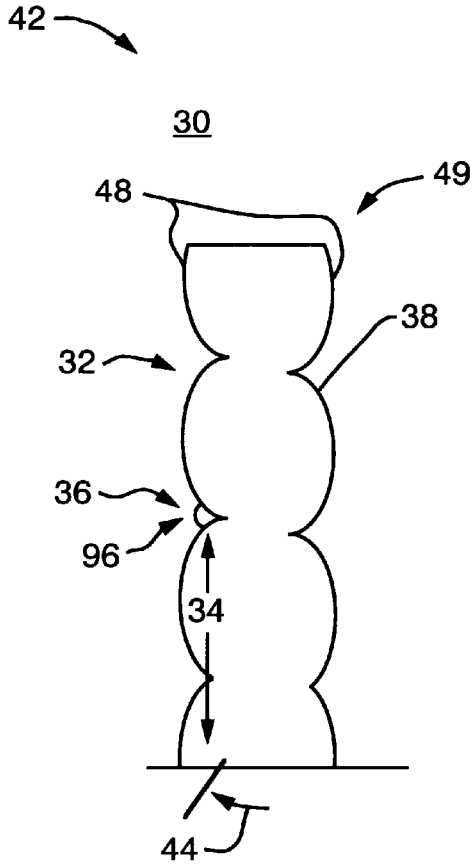

One possible digital imaging device 40, in FIG. 5, for this inventive method 10 is a digital camera 60 with a back lighting device 62 behind the drill bit 30. Another possible digital imaging device 40 is a series of lasers that at least partially illuminate the drill bit 30 to produce a digital image 42 and determine the geometric shape 32 of the drill bit 30. Other digitally imaging devices are contemplated.

Figure 7:
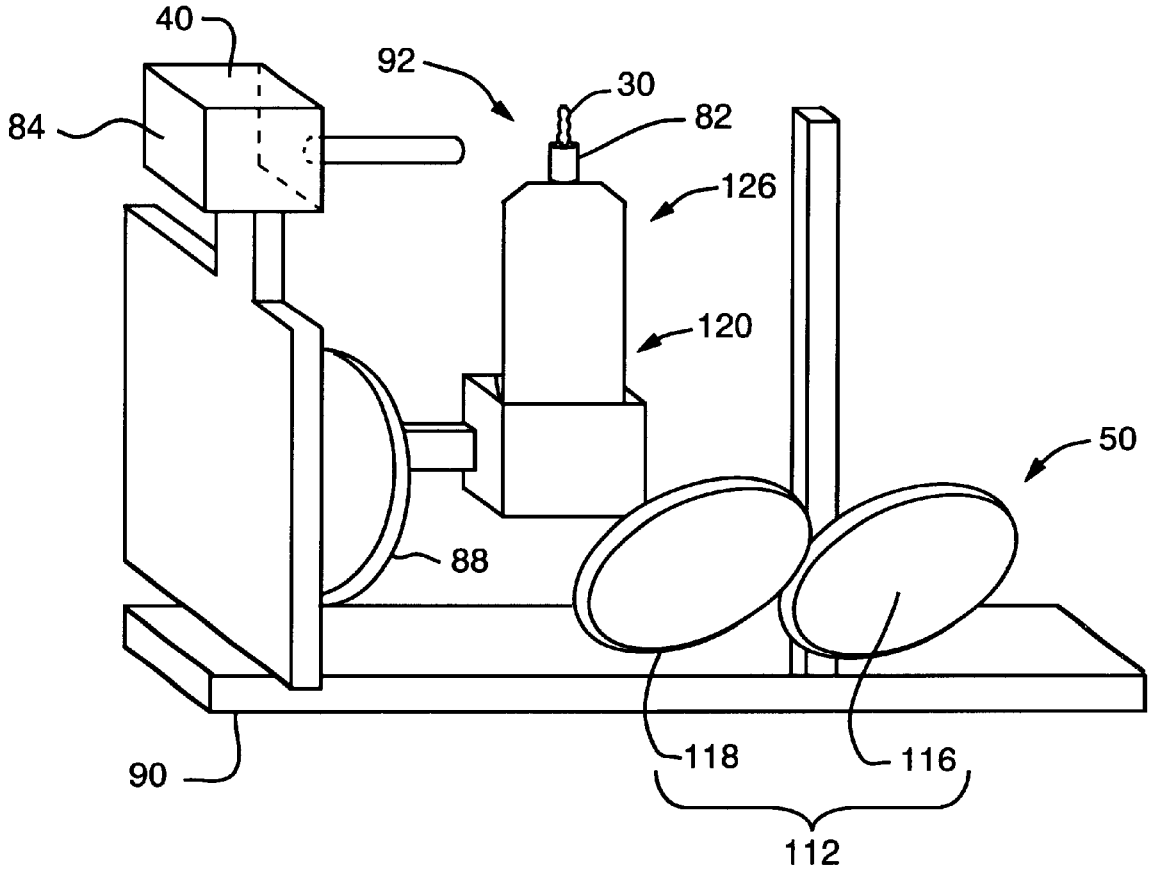
FIG. 7 shows a side view of the drill grinding assembly.

One apparatus 80 for performing this invention is shown in FIG. 7. A drill bit 30 is located and picked up by the robot leader and placed into the collate 82 in its vertical orientation. The vision system 84 determines whether the drill bit 30 is positioned correctly and feeds that information to the supervising computer which adjusts the position of the drill bit 30 by moving the rotation 88 and/or the linear translation stage 90 until the drill bit 30 is correctly located in the field of view 92 of the digital imaging device 40. The drill bit 30 is slowly rotated about the helix axis 39 while digital pictures 42 are taken. Position of the primary inflection point 36 is determined relative to a fixed position, such as the top of the drill bit 30, and displacement is calculated as a function of the rotation angle 44. The position and movement of the secondary inflection points 96 are also determined. Primary 98 and maximum 100 drill bit 30 diameters are determined. Web height is calculated from this information as simply one half the difference between the primary 98 and maximum 100 diameters. Finally the difference between the apparent minimum diameter 104 and the end 106 of the drill bit 30 is calculated. Using a predetermined offset value, the rotation of the collate 82 required to orient the drill bit 30 for presentation to the grinding wheels 112 is calculated. That is, depending on how much stock is to be removed, the drill bit 30 is rotated 18 so that it is presented to the secondary 116 and primary 118 grinding wheels 112. The assembly 120 is rotated to the horizontal position 122, FIG. 6, and the drill bit 30 is translated through a bushing for stock removal by primary 118 and secondary 116 grinding wheels 112. The assembly 120 is moved across the grinding wheels 112 and returned to the vertical position 126. A linear stage is retracted partially from the bushing and the drill bit 30 rotated 180 degrees. The stock removal process is repeated so that the other side of the drill bit 30 can be ground. All measurements are accomplished using a projected area of the drill bit 30 on the digital imaging device 40. The drill bit 30 is backlit using a collimated fiber optic bundle or LED light source.

Figure 8:
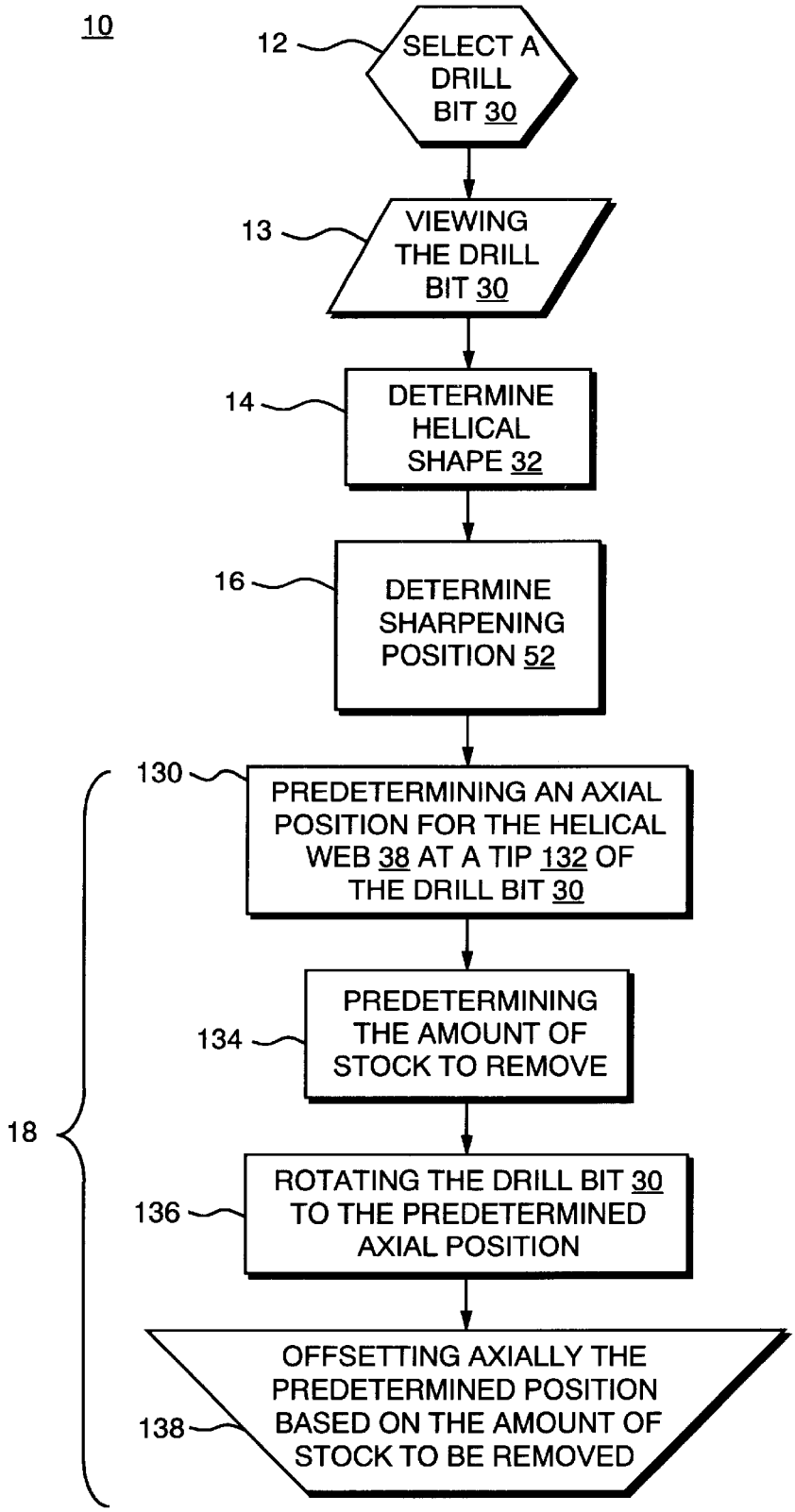
FIG. 8 shows a flow chart of another embodiment of the claimed method for properly positioning a drill bit to be sharpened.

One method, in FIG. 8, for placing the drill bit 30 in the sharpening position begins by predetermining 130 an axial position where the helical web 38 at a tip 132 of the drill bit 30 should be placed. Predetermining 130 the axial position is based upon the position of the sharpening means 50 with respect to the assembly 120 and, if done correctly, only needs to be performed once per apparatus 80 for a range of drill bit 30 sizes. The next step in this method is predetermining 134 a fixed amount of stock to remove from the drill bit 30. A minimal amount of stock must be removed from the drill bit 30 to have any sharpening effect. The next step is rotating 136 the drill bit 30 to the predetermined axial position. The final step is offsetting 138 axially the predetermined position by the amount of stock to be removed.

What is claimed is:

1. A method for properly positioning a drill bit to be sharpened, said method comprising:

selecting a drill bit with a substantially helical geometric shape;

viewing a drill bit with a digital imaging device;

obtaining multiple digital images of the drill bit as the drill bit is rotated known units of angular rotation;

comparing a difference in vertical location of a reference point on a helical web on the drill bit, visible on at least two of the digital images, to the known units of angular rotation between the digital images;

calculating the geometric shape of the drill bit;

calculating a sharpening position, relative to a sharpening means, for sharpening the dill bit based on the geometric shape of the drill bit; and placing the drill bit in the sharpening position, relative to the sharpening means.

2. The drill bit positioning method of claim 1 wherein the axis on which the drill bit is rotated is a lengthwise axis of the drill bit.

3. A method for properly positioning a drill bit to be sharpened, said method comprises:

selecting a drill bit with a substantially helical geometric shape;

viewing a drill bit with a digital imaging device;

obtaining a first digital image of a first profile of the drill bit;

rotating the drill bit a known unit of angular rotation;

obtaining a second digital image of a second profile of the drill bit;

comparing a difference in vertical location of a reference point visible on a helical web on the drill bit in both the first profile and the second profile of the drill bit in relation to the known unit of angular rotation by which the drill bit was rotated;

calculating a geometric shape of the drill bit;

calculating a sharpening position, relative to a sharpening means, for sharpening the drill bit based on the geometric shape of the drill bit; and placing the drill bit in the sharpening position, relative to the sharpening means.

4. A method for properly positioning a drill bit to be sharpened, said method comprising:

selecting a drill bit with a substantially helical geometric shape;

viewing a drill bit with a digital imaging device;

determining the geometric shape of the drill bit;

calculating a sharpening position, relative to a sharpening means, for sharpening the drill bit based on the geometric shape of the drill bit;

predetermining an axial position where a helical web at a tip of the drill bit should be placed;

predetermining a fixed amount of stock to remove from the drill bit;

rotating the drill bit to the predetermined axial position; and offsetting axially the predetermined position by the amount of stock to be removed.

5. The drill bit positioning method of claim 4 wherein the digital imaging device is a digital camera with a back lighting device behind the drill bit.

6. The drill bit positioning method of claim 4 wherein the digital imaging device is a series of lasers that at least partially illuminate the drill bit to produce a digital image and determine the geometric shape.

* * * * *